US006546266B1

(12) United States Patent
Okazaki et al.

(10) Patent No.: US 6,546,266 B1
(45) Date of Patent: Apr. 8, 2003

(54) FILTER DEVICE HAVING INDEPENDENTLY ADJUSTABLE FILTERING CHARACTERISTICS AND METHOD OF ADJUSTING CENTRAL FREQUENCY OF THE SAME

(75) Inventors: Mitsunari Okazaki, Yokohama (JP); Nobuyoshi Sakakibara, Nishio (JP)

(73) Assignee: Cryodevice Inc., Nisshin (JP)

( * ) Notice: Subject to any disclaimer, the term of this patent is extended or adjusted under 35 U.S.C. 154(b) by 86 days.

(21) Appl. No.: 09/671,137

(22) Filed: Sep. 28, 2000

(30) Foreign Application Priority Data

Apr. 20, 2000 (JP) ..... 2000-119530

(51) Int. Cl.[7] ..... H01P 1/203; H01B 12/02

(52) U.S. Cl. ..... 505/210; 333/99 S; 333/205; 505/700; 505/866

(58) Field of Search ..... 333/99 S, 205; 505/210, 200, 866

(56) References Cited

U.S. PATENT DOCUMENTS 5,397,769 A * 3/1995 Higaki et al. ..... 333/99 S X
5,459,123 A * 10/1995 Das ..... 333/99 S X
5,965,494 A * 10/1999 Terashima et al. ..... 333/99 S X

* cited by examiner

*Primary Examiner*—Benny T. Lee
(74) *Attorney, Agent, or Firm*—Law Offices of David G. Posz

(57) ABSTRACT

A filter device includes a super-conducting type filters connected in series with each other and is accommodated in a vacuum chamber. Operating temperatures of the filters are controlled to different temperatures from the outside of the vacuum chamber independently of each other. Each filter varies its filtering characteristics, particularly its central frequency of pass-band, in correspondence with the operating temperature, while maintaining the same pass-band width. As the filters operated at the different operating temperatures provide different filtering characteristics, the combined or resulting filtering characteristics of the filtering device can be adjusted as desired even after the filtering device is installed at a mobile telecommunication base station.

17 Claims, 8 Drawing Sheets

FILTER DEVICE HAVING INDEPENDENTLY ADJUSTABLE FILTERING CHARACTERISTICS AND METHOD OF ADJUSTING CENTRAL FREQUENCY OF THE SAME

CROSS REFERENCE TO RELATED APPLICATION

This application relates to and incorporates herein by reference Japanese Patent Application No. 2000-119530 filed. Apr. 20, 2000.

BACKGROUND OF THE INVENTION

The present invention relates to a filter device having adjustable filtering characteristics, that is, an adjustable frequency response, and a method of adjusting the central frequency of the pass-band of the filter device.

In mobile telecommunications using high frequency waves, filter devices are used to pass only signals of predetermined frequencies and cut off other signals of other frequencies. The filter device generally employs a dielectric-type filter or a cavity resonator-type filter. Those filter devices are constructed to maintain the filtering characteristics (frequency response) thereof, even when the operating temperature near the room temperature changes. The filtering characteristics are usually adjusted by changing the resonance frequency of each resonator in the filter device or changing the coupling among the adjacent resonators by way of screws or the like. It is however impossible to adjust the filtering characteristics once the filter device has been installed in a closed-type mechanical apparatus, for instance, in a mobile telecommunication base station.

SUMMARY OF THE INVENTION

It is an object of the present invention to enable adjustment of filtering characteristics, that is, a frequency response, of a filter device even after installation in a closed mechanical apparatus.

According to the present invention, a filter device includes filters connected in series with each other. Operating temperatures independently of each other. Each filter varies its filtering characteristics (frequency response), particularly its central frequency of pass-band width, in correspondence with the operating temperature, while maintaining the same pass-band width. As the filters operated at the different operating temperature provide different filtering characteristics, the combined or resulting filtering characteristics of the filtering device can be adjusting as desired even after the filtering device is installed at a mobile telecommunication base station.

When a filter device includes only one filter, the filtering characteristics, particularly the central frequency of its pass-band width, are adjusted by varying the operating temperature of the filter from outside of the filter device after installation at a telecommunication base station.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENT

Figure 1:
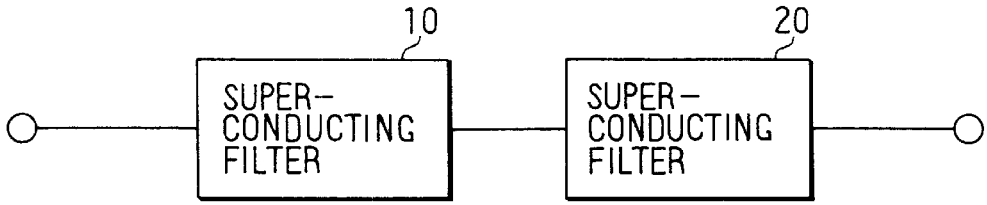
FIG. 1 is a block diagram showing a filter device using two super-conducting filters to have an adjustable bandpass width according to a first embodiment of the present invention.

The present invention will be described in more detail with reference to various embodiments in which the same or similar parts are designated with the same or similar reference numerals.

(First Embodiment)

Referring first to FIG. 1, a filter device is constructed as a pass-band width adjustable type by a first super-conducting filter 10, a second super-conducting filter 20 and other components. The filters 10 and 20 are electrically connected in series with the output of the filter 10 being connected to the input of the filter 20. Each filter may be a planar type of a micro strip line structure. In this structure, a resonator is formed on a top surface of a dielectric substrate body by a super-conducting material of a YBCO (yttrium barium copper oxide) system, for instance, and a ground plane is formed on a bottom surface of the dielectric substrate body. Each filter is constructed to have the same filtering characteristics (frequency response) including the same frequency cut-off characteristics.

Figure 2:
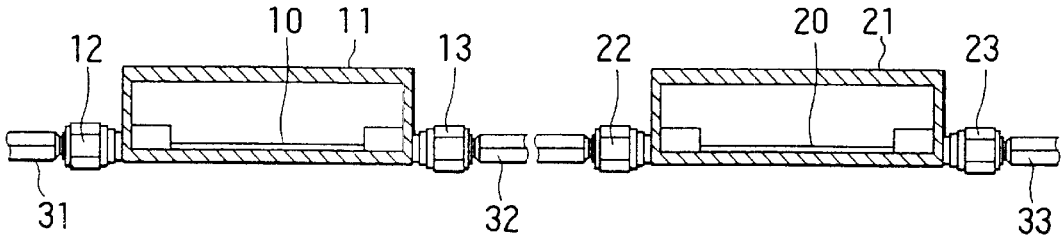
FIG. 2 is a sectional view showing the filter device according to the first embodiment.

The filter device is more specifically constructed as shown in FIG. 2. The filters 10 and 20 are installed in filter casings 11 and 21, respectively. An input connector 12 and an output connector 13 are attached to the casing 11, and an input connector 22 and an output connector 23 are attached to the casing 21. The input side of the filter 10 is electrically connected to an input cable 31 through the input connector 12, and the output side of the filter 10 is electrically connected to a connecting cable 32 through the output connector 13. The input side of the filter 20 is electrically connected to the connecting cable 32 through the input connector 22, and the output side of the filter 20 is electrically connected to an output cable 33 through the output connector 23.

Figure 3:
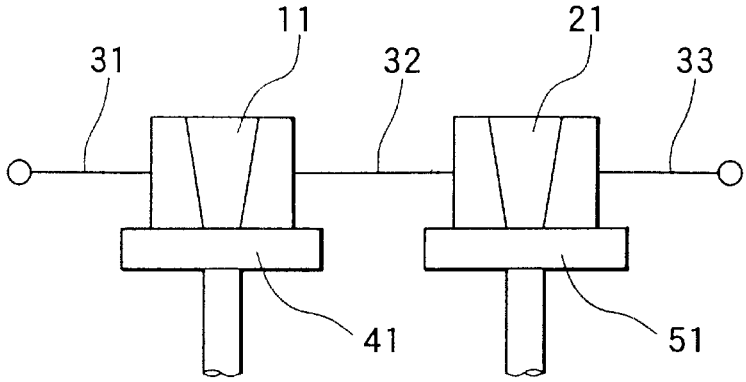
FIG. 3 is a schematic view showing the filter device according to the first embodiment.

The filter casings 11 and 21 are fixed by screws to cooling stages 41 and 51, respectively, as shown in FIG. 3. Thus, the filters 10 and 20 (FIG. 2) provide filtering characteristics when cooled to to a temperature lower than the critical temperature by the cooling stages 41 and 51, respectively.

Figure 4:
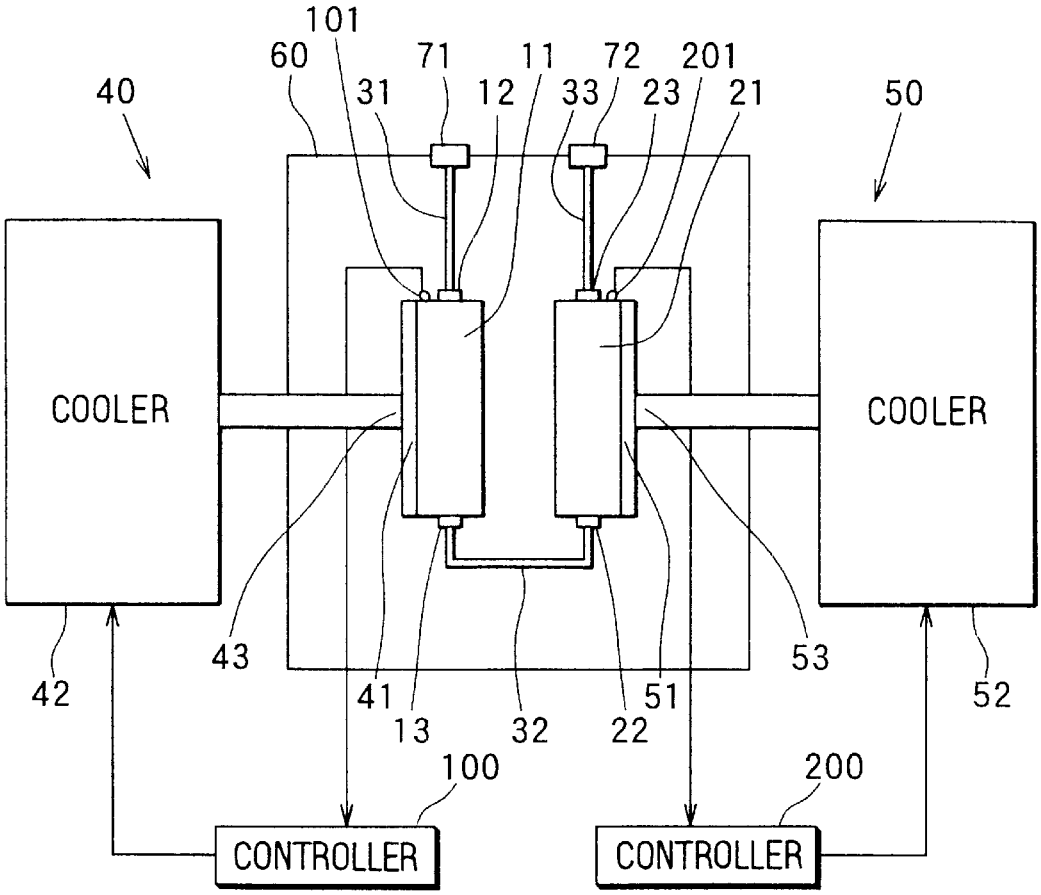
FIG. 4 is a detailed structural view showing the filter device according to the first embodiment.

As shown in FIG. 4, the filter casings 11 and 21 are accommodated within a heat-insulated vacuum chamber 60 and connected in series through the input cable 31, the connecting. cable 32 and the output cable 33. The input cable 32 and the output cable 33 are connected to connectors 71 and 72 mounted on the chamber 60, respectively, for connection with external devices (not shown).

The cooling stages 41 and 51 are coupled with coolers 40 and 50, respectively, which may be a pulse tube-type refrigerating unit. The cooler 40 has a cooler body 42 and a cold head 43 which is fixedly coupled with the cooling stage 41. The cooler 50 has a cooler body 52 and a cold head 53 which is fixedly coupled with the cooling stage 51. The cooler bodies 42 and 52 are provided outside the vacuum chamber 60. The filters 10 and 20 in the casings 11 and 21 are cooled by thermal conduction to the cooling stages 41 and 51, when the coolers 40 and 50 operate.

The coolers 40 and 50 are controlled by electronic controllers 100 and 200, respectively. The controllers 100 and 200 have respective temperature setting members (not shown). The controller 100 is connected to a thermometer 101 mounted on the casing 11 to detect the temperature of the filter 10 (FIG. 2) located within the casing 11. The controller 100 thus feedback controls the cooling capacity of the cooler 40 so that the filter 10 (FIG. 2) may be maintained at a desired temperature set by its temperature setting member. The controller 200 is connected to a thermometer 201 mounted on the casing 21 to detect the temperature of the filter 21. The controller 100 thus feedback controls the cooling capacity of the cooler 50 so that the filter 21 may be maintained at another desired temperature set by its temperature setting member. Thus, temperature of the filters 10 and 20 (FIG. 2) are controlled to different values independently of each other so that the filtering characteristics of the filters 10 and 20 may be varied independently of each other.

Figure 5A:
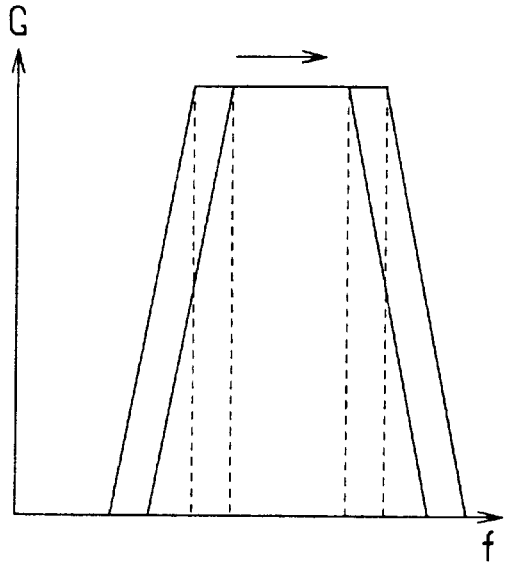
FIGS. 5A and 5B are graphs showing filtering characteristics of each super-conducting filter used in the first embodiment.
Figure 5B:
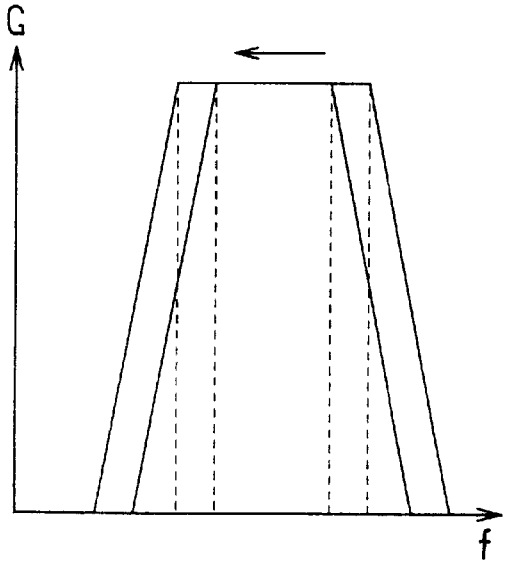

According to experiments with regard to the planar-type YBCO super-conducting filter, it was found that the filtering or attenuation characteristics of each super-conducting filter change with temperature as shown in FIGS. 5A and 5B which show the relationship between a signal frequency (f) and gain (G). Specifically, as shown in FIG. 5A, the central frequency of the pass-band shifts to a higher frequency side when the operating temperature falls from 70 K (Kelvin) to 55 K, for instance. On the contrary, as shown in FIG. 5B, the central frequency of the pass-band shifts to a lower frequency side when the operating temperature rises to 75 K. In either case, the pass-band width remains unchanged. The shift depends on the specification of the filter. From this experiment result, a shift of about 100 KHz/K is expected to occur in the case of a super-conducting filter having the central frequency of 2 GHz and the specific pass-band is 1.0%. It is therefore possible to adjust the filtering characteristics of the filter device by operating a plurality of super-conducting filters at different temperatures.

Figure 6A:
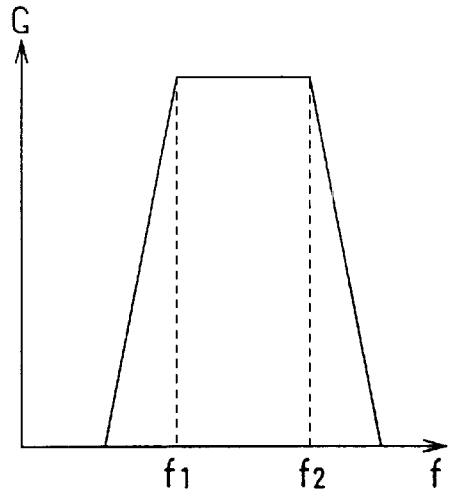
FIGS. 6A and 6B are graphs showing filtering characteristics of the super-conducting filters used in the filter device according to the first embodiment and operated at temperature of 70 K, respectively.
Figure 6B:
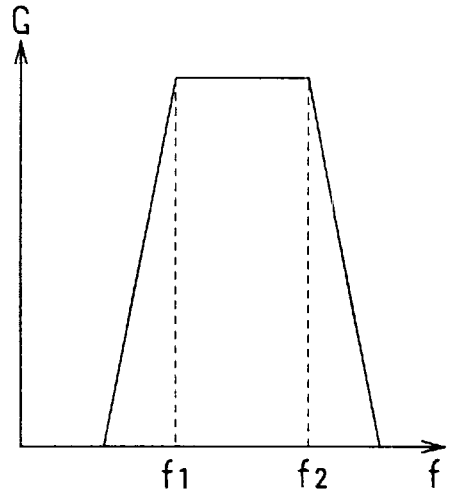
Figure 6C:
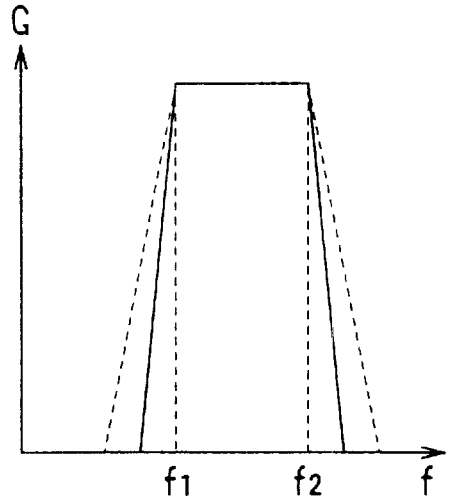
FIG. 6C is a graph showing filtering characteristics of the filter device according to the first embodiment in which the super-conducting filters are connected in series and operated at temperature of 70 K.

The filters 10 and 20 (FIG. 2) provide the same filtering characteristics shown in FIGS. 6A and 6B, respectively, if operated at 70 K. The pass-band of each filter is from f1 to f2. As the filters 10 and 20 are connected in series, the filter device provides final or resulting filtering characteristics as shown in FIG. 6C. The resulting filtering characteristics [has] have sharper cut-off characteristics while having the same pass-band ranging from f1 to f2.

Figure 7A:
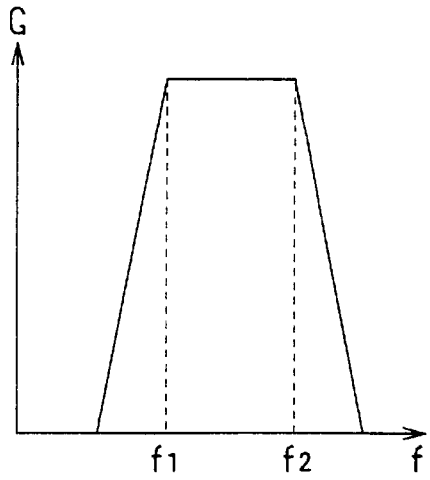
FIGS. 7A and 7B are graphs showing filtering characteristics of the super-conducting filters used in the filter device according to the first embodiment and operated at temperatures of 70 K and 60 K, respectively.
Figure 7B:
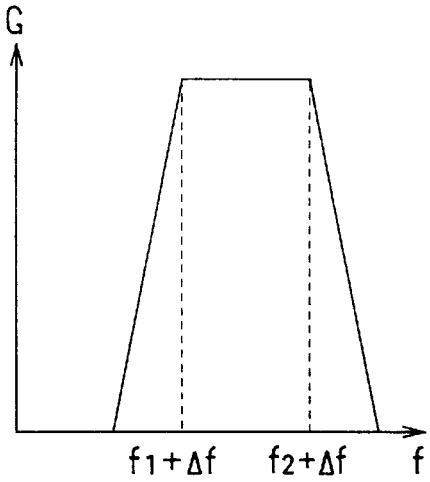
Figure 7C:
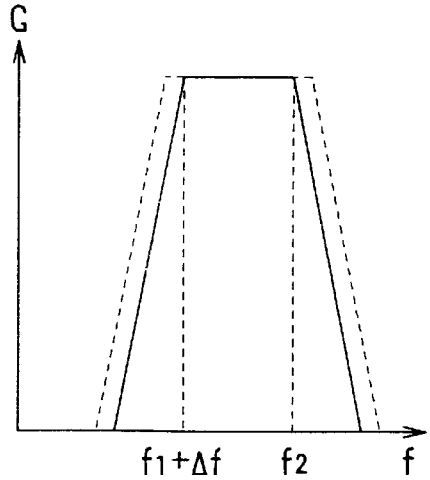
FIG. 7C is a graph showing filtering characteristics of the filter device in which the super-conducting filters are connected in series.

The filters 10 and 20 (FIG. 2) provide filtering characteristics shown in FIGS. 7A and 7B if operated at 70 K and 60 K, respectively. The filtering characteristics of the filter 10 shown in FIG. 7A is the same as that shown in FIG. 6A, because the filter 10 is operated at the same temperature. However, as shown in FIG. 7B, the pass-band of the filter 20 is increased to be from f1+Δf to f2+Δf and the central frequency is increased by Δf, because the filter 20 is operated at the elevated temperature 70 K. As a result, the filter device provides resulting filtering characteristics as shown in FIG. 7C. The resulting filtering characteristics have a pass-band from f1+Δf to f2. This is because, in the case of series connection of filters, the lower cut-off frequency is determined by the higher one of the two lower cut-off frequencies f1 and f1+Δf, and the higher cut-off frequency is determined by the lower one of the two higher cut-off frequencies f2 and f2+Δf.

The filter device shown in FIG. 4 is used, for instance, as an RF (radio frequency) filter for a receiver at a mobile telecommunication base station. In this instance, a filter device of a narrow pass-band width is required at some base stations that are likely to be interfered by other telecommunication systems operating at adjacent frequency pass-bands. On the-other hand, a filter device of a wide pass-band width is required at other base stations that are less likely to be interfered by the other communication systems. The interference must be checked from site to site where the filter device is to be installed. The above filter device is enabled to adjust the filtering characteristics as desired by independently varying operating temperatures of a plurality of filters at the site of installation.

The filter device shown in FIG. 4 is used, for instance, as an RF (radio frequency) filter for a receiver at a mobile telecommunication base station. In this instance, a filter device of a narrow pass-band width is required at some base stations that are likely to be interfered by other telecommunication systems operating at adjacent frequency pass-bands. On the other hand, a filter device of a wide pass-band width is required at other base stations that are less likely to be interfered by the other communication systems. The interference must be checked from site to site where the filter device is to be installed. The above filter device is enabled to adjust the filtering characteristics as desired by independently varying operating temperatures of a plurality of filters at the site of installation.

The controllers 100 and 200 may be constructed as remote controllers to control coolers 40 and 50 from the ground level even if communication devices are located at an elevated height, for instance, at the top of a communication tower.

(Second Embodiment)

Figure 8:
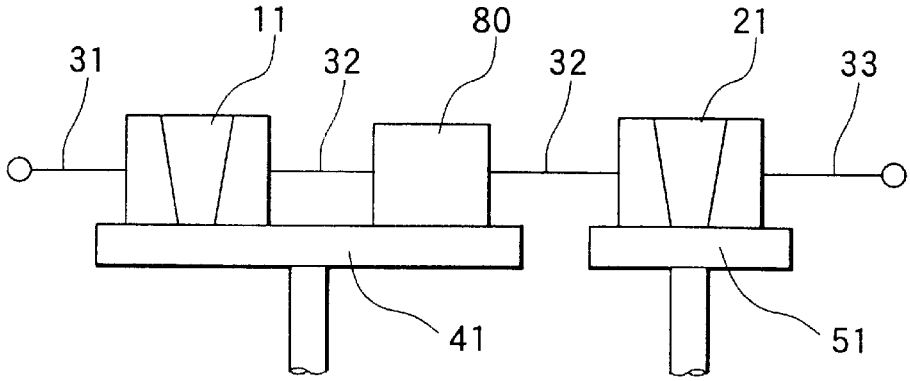
FIG. 8 is a schematic view showing a filter device according to a second embodiment of the present invention.

In a second embodiment, as shown in FIG. 8, an isolator 80 is provided between the super-conducting filters 10 and 20 (FIG. 2) located inside filter casings 11, 21. The isolator 80 is provided on the cooling stage 41 and connected to the filters 10 and 20 through connecting cables 32. The isolator 80 operates to suppress an increase of return loss of the filters 10 and 20 arising from impedance mismatching between the filters 10 and 20.

Figure 9:
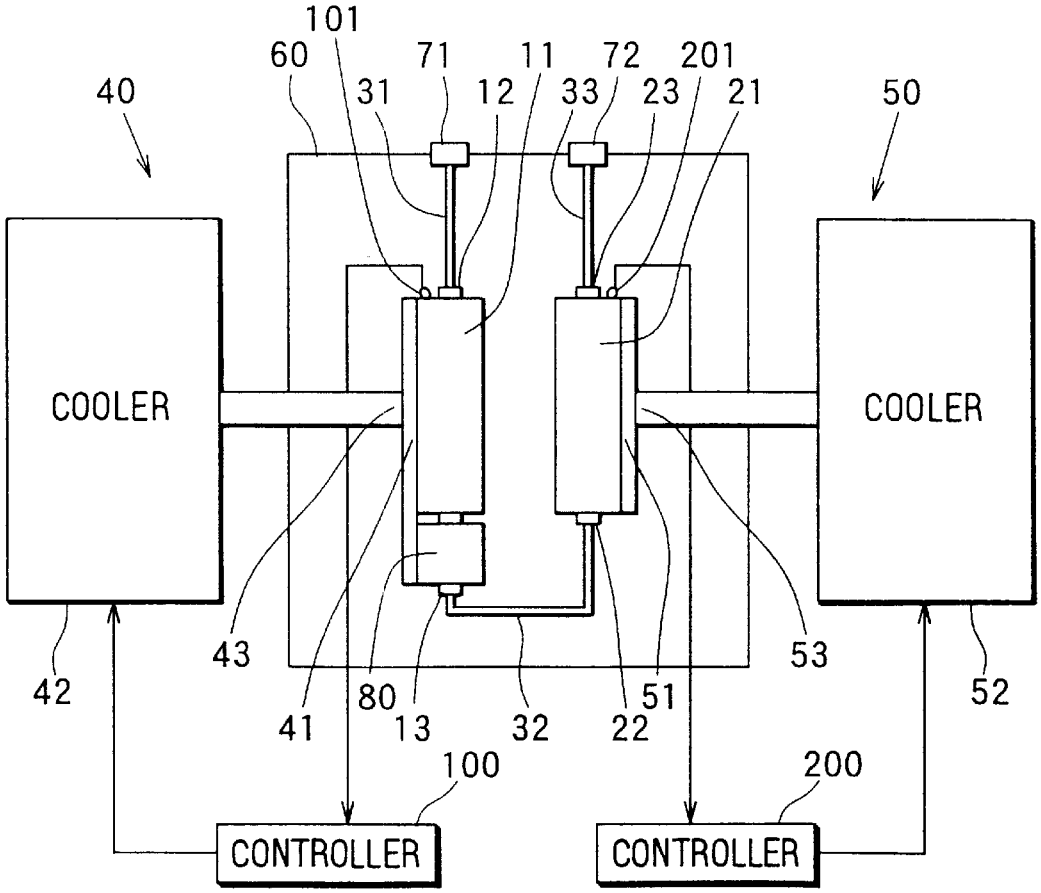
FIG. 9 is a detailed structural view showing the filter device according to the second embodiment.

As shown in FIG. 9, the isolator 80 is mounted on the cooling stage 41 in addition to the construction of the first embodiment shown in FIG. 4. The isolator 80 may alternatively be mounted on the cooling stage 51.

(Third Embodiment)

Figure 10:
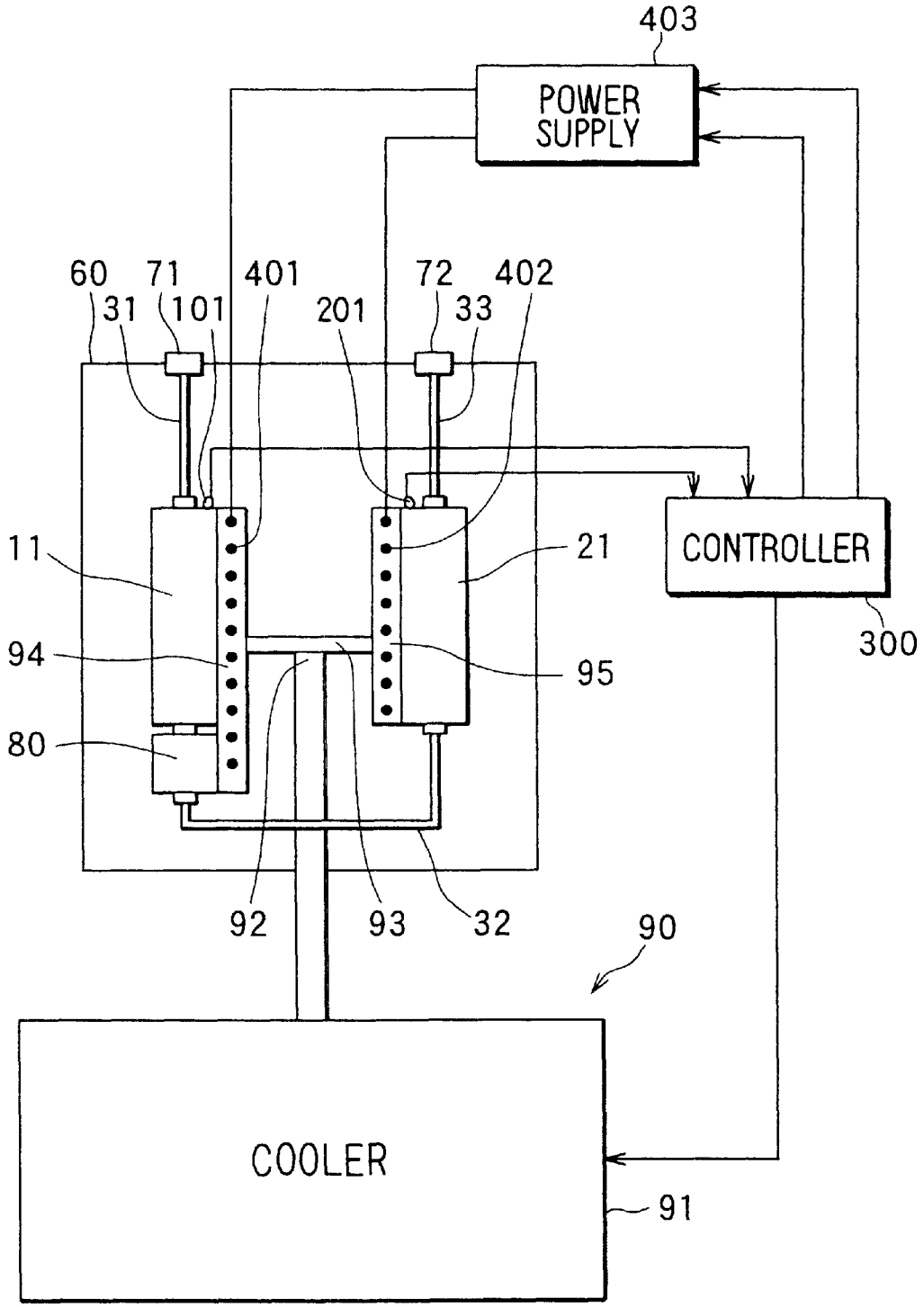
FIG. 10 is a detailed structural view showing a filter device according to a third embodiment of the present invention.

In a third embodiment, as shown in FIG. 10, only one cooler 90 is employed in place of the two coolers 40 and 50 in the foregoing embodiments. The cooler 90 includes a cooler body 91, a cold head 92, a heat diffuser plate 93 and a pair of cooling stages 94 and 95 that may be heat diffuser plates. The casing 11 accommodating the filter 10 (FIG. 2) and the isolator 80 are fixedly mounted on the cooling stage 94, and the casing 21 accommodating the filter 20 (FIG. 2) is fixedly mounted on the cooling stage 95.

The cooling stages 91 and 92 are provided with heater wires 401 and 402 therein, respectively. The heater wires 401 and 402 are connected to a power supply circuit 403. An electronic controller 300 is connected to the power supply circuit 403 and the cooler 90. The controller 300 controls the cooler 90 to a set temperature and controls heater wires 401 and 402 independently of each other through the power supply circuit 403.

The controller 300 operates as follows when, for instance, the temperatures of the filters 10 and 20 (FIG. 2) inside the respective casings 11, 21 are set to 70 K and 60 K, respectively, by temperature setting members (not shown) of the controller 300. The controller 300 controls the cooler 90 to cool both filters 10 and 20 to the lower temperature 60 K of the two set temperatures 70 K and 60 K. The controller 300. controls the power supply circuit 403 to supply electric power to only the heating wire 401 so that the temperature of the filter 10 is raised to 70 K. However, the controller 300 feedback-controls the cooler 90 and the heater wires 401 and 402 in response to the actual temperatures detected by the thermometers 101 and 201 so that the temperatures of the filters 10 and 20 are maintained at the respective set temperatures. As a result, the cooling stages 94 and 95 are maintained at different temperatures so that the filtering characteristics of the filters 10 and 20 are differentiated to provide desired final or resulting filtering characteristics as described above.

In the third embodiment, it is likely to occur that heat moves through the plate 93 from one cooling stage to the other cooling stage causing deviation of the temperatures of the filters 10 and 20 (FIG. 2) from the set temperatures, when the cooling stages 94 and 95 are controlled to different temperatures. This heat transfer may be reduced by forming the plate 93 to have a restrictor. It is preferred to ensure heat transfer during cooing operation of the cooler 90 and to reduce heat transfer during heating operation of the heating wires 401 and 402. For this purpose, a bypass may be provided to bypass the restrictor. For instance, the cold heat from the cooler 90 is allowed to move through the bypass, but the heat of the heating wires 401 and 402 are allowed to move only through the restrictor by closing the bypass during the heating operation.

In the third embodiment, the isolator 80 may be mounted on the cooling stage 95 or may be eliminated. Further, the heating wires 401 and 402 may be replaced with other heating means as long as they are capable of being controlled independently of each other. The heating means may be provided for only one of the filters 10 and 20 (FIG. 2), which is to be maintained at higher one of the set temperatures.

(Fourth Embodiment)

Figure 11:
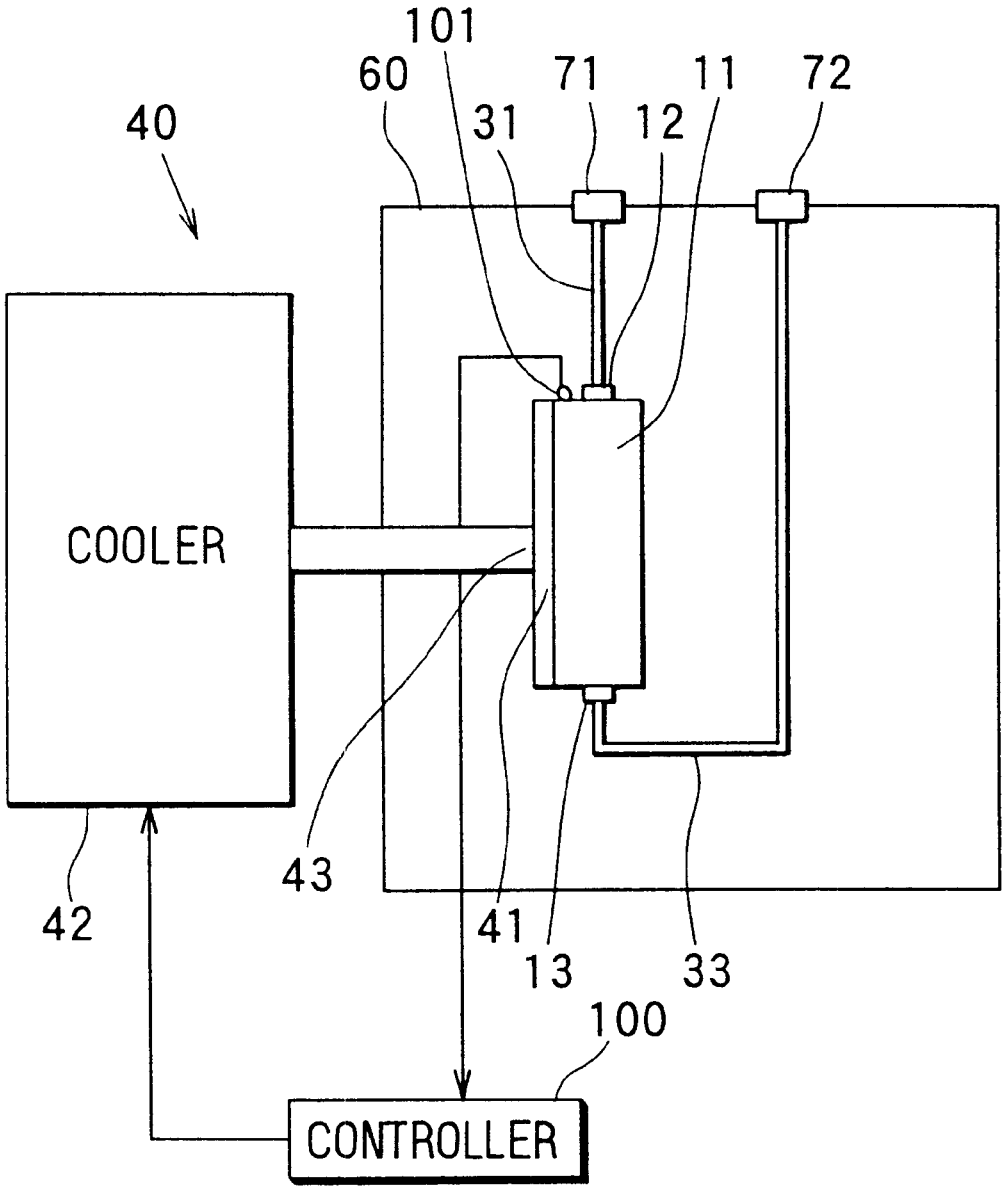
FIG. 11 is a detailed structural view showing a filter device according to a fourth embodiment of the present invention.

In a fourth embodiment, as shown in FIG. 11, only one super-conducting filter 10 accommodated in the casing 11 is provided in the chamber 60 and hence only the cooler 40 and the controller 100 are provided. The filtering characteristics, particularly the central frequency, of the filter 10 are adjusted as shown in FIGS. 5A and 5B by varying the temperature of the filter 10.

The filter device according to the fourth embodiment may also be installed as a RF filter of a receiver in a mobile telecommunication base station, for instance. Specifically, this filter device may be used in the case in which the interference of other communication systems is on only one side of the pass-band. In this instance, the interference can be minimized by changing the operating temperature of the filter 10 to shift the central frequency of the filter 1. at the site the filter device is installed.

The present invention should not be limited to the disclosed embodiments. but may be implemented in various other ways. For instance, the filters may have different frequency cut-off characteristics from each other. The filters may be a normal conducting type, because such filters also exhibit similar changes in the filtering characteristics as the super-conducting type if cooled to be low enough (for instance, −200° C. An amplifier may be provided as the isolator between the filters. More than two filters may be connected in series.

What is claimed is:

1. A filter device comprising:

a first filter casing accommodating therein a first super-conducting filter;

a second filter casing accommodating therein a second super-conducting filter connected in series with the first super-conducting filter;

a vacuum chamber accommodating the first filter casing and the second filter casing therein; and temperature control means for controlling the first super-conducting filter and the second super-conducting filter to different operating temperatures independently of each other, wherein the first and second filters each include a resonator disposed on a dielectric substrate.

2. A filter device comprising:

a first filter having filtering characteristics variable with operating temperatures;

a second filter having filtering characteristics variable with operating temperatures; and an isolator provided between the first filter and the second filter;

wherein the first filter and the second filter are connected in series and constructed to be controlled independently of each other with respect to the operating temperatures.

3. The filter device as in claim 2, further comprising:

temperature control means for controlling the operating temperatures of the first filter and the second filter independently of each other.

4. The filter device as in claim 3, wherein:

the first filter and the second filter include a first super-conducting filter and a second super-conducting filter, respectively; and the temperature control means controls the first super-conducting filter and the second super-conducting filter to a first temperature and a second temperature different from the first temperature, respectively.

5. The filter device as in claim 3, wherein:

the first filter and the second filter include a first super-conducting filter and a second super-conducting filter, respectively; and the temperature control means includes cooler means and heater means, the cooler means being for cooling both the first super-conducting filter and the second super-conducting filter and the heater means being for heating at least one of the first super-conducting filter and the second super-conducting filter so that the first super-conducting filter and the second super-conducting filter may be controlled to a first temperature and a second temperature different from the first temperature, respectively.

6. A filter device comprising:

a first filter casing accommodating a first super-conducting filter therein;

a second filter casing accommodating a second super-conducting filter therein;

a connecting member electrically connecting an output of the first super-conducting filter and an input of the second super-conducting filter; and cooler means having a first cooling stage and a second cooling stage, the first cooling stage fixedly mounting the first filter casing thereon and the second cooling stage fixedly mounting the second filter casing thereon, wherein the first super-conducting filter and the second super-conducting filter are controllable to operate at different operating temperature.

7. The filter device as in claim 6, wherein:

the connecting member includes an isolator.

8. The filter device as in claim 7, wherein:

the isolator is fixed to one of the first cooling stage and the second cooling stage.

9. The filter device as in claim 6, wherein:

the cooler means includes first cooling means and second cooling means which cool the first cooling stage and the second cooling stage independently of each other, respectively.

10. The filter device as in claim 6, wherein:

the cooler means equally cools the first super-conducting filter and the second super-conducting filter through the first cooling stage and the second cooling stage, respectively; and heater means is provided to heat at least one of the first super-conducting filter and the second super-conducting filter.

11. A filter device comprising:

a first filter casing accommodating therein a first super-conducting filter;

a second filter casing accommodating therein a second super-conducting filter connected in series with the first super-conducting filter;

an isolator provided between the first filter casing and the second filter casing;

a vacuum chamber accommodating the first filter casing and the second filter casing therein; and temperature control means for controlling the first super-conducting filter and the second super-conducting filter to different operating temperatures independently of each other.

12. A filtering characteristics adjusting method comprising:

installing first and second filters each having a resonator in an apparatus;

installing an isolator between the first and second filters; and varying respective operating temperatures of the first and second filters to adjust a central frequency of filtering characteristics of each of the first and second filters.

13. The filtering characteristics adjusting method as in claim 12, wherein:

the first and second filters are super-conducting filters; and the apparatus is a vacuum chamber.

14. A filtering characteristics adjusting method comprising:

installing a filter device at a mobile telecommunication base station, the filter device including a plurality of series-connected filters each having a single resonator, the plurality of series-connected filters accommodated in a chamber and a temperature control device provided outside the chamber; and driving the temperature control device to vary operating temperatures of the filters independently of each other.

15. The filtering characteristics adjusting method as in claim 14, wherein:

the filters have the same filtering characteristics with respect to cut-off frequencies and a central frequency of a pass-band at same operating temperature; and the filters are operated at different operating temperatures to vary the central frequency so that the filter device provides a resulting filtering characteristics that is different from the same filtering characteristics.

16. A filter device comprising:

a first filter having filtering characteristics variable with operating temperatures; and a second filter having filtering characteristics variable with operating temperatures;

wherein the first filter and the second filter are connected in series and constructed to be controlled independently of each other with respect to the operating temperatures and wherein the first and second filters each include a resonator disposed on a dielectric substrate.

17. The filter device of claim 16, wherein the resonator is comprised of a superconducting material.

* * * * *

UNITED STATES PATENT AND TRADEMARK OFFICE

CERTIFICATE OF CORRECTION

PATENT NO. : 6,546,266 B1
DATED : April 8, 2003
INVENTOR(S) : Mitsunari Okazaki et al.

It is certified that error appears in the above-identified patent and that said Letters Patent is hereby corrected as shown below:

Title page,
Item [54], Title, correct to read: -- FILTER DEVICE HAVING ADJUSTABLE FILTERING CHARACTERISTICS AND METHOD OF ADJUSTING CENTRAL FREQUENCY OF THE SAME --

Signed and Sealed this

Twelfth Day of April, 2005

JON W. DUDAS
*Director of the United States Patent and Trademark Office*